US006296241B1

(12) United States Patent
Harrison

(10) Patent No.: US 6,296,241 B1
(45) Date of Patent: Oct. 2, 2001

(54) ADJUSTABLE C-CLAMP

(76) Inventor: John P. Harrison, 261 Peyton Colquitt, Shreveport, LA (US) 71115

( * ) Notice: Subject to any disclaimer, the term of this patent is extended or adjusted under 35 U.S.C. 154(b) by 0 days.

(21) Appl. No.: 09/606,948

(22) Filed: Jun. 30, 2000

(51) Int. Cl.[7] ..... B25B 1/10
(52) U.S. Cl. ..... 269/249; 269/172; 269/182
(58) Field of Search ..... 209/249, 181, 209/182, 179, 183, 246, 286, 184, 185, 186, 187, 273, 172; 411/437

(56) References Cited

U.S. PATENT DOCUMENTS

| | | | | |
|---|---|---|---|---|
| 2,755,681 | | 7/1956 | Merriman . | |
| 2,812,789 | | 11/1957 | Hutson . | |
| 3,245,676 | | 4/1966 | Floren . | |
| 3,403,901 | | 10/1968 | Servadio . | |
| 3,704,014 | * | 11/1972 | Keene | 269/172 |
| 4,083,624 | | 4/1978 | Timmer . | |
| 4,627,604 | | 12/1986 | Choi . | |
| 5,893,553 | * | 4/1999 | Pinkous | 269/249 |
| 6,098,973 | * | 8/2000 | Khachatoorian | 269/182 |
| 6,135,032 | * | 10/2000 | Ko | 108/96 |
| 6,138,973 | * | 10/2000 | Woodward | 248/423 |

FOREIGN PATENT DOCUMENTS

| | | | | |
|---|---|---|---|---|
| 3228646 | * | 10/2000 | (DE) | 269/172 |

* cited by examiner

*Primary Examiner*—Joseph J. Hail, III
*Assistant Examiner*—Daniel Shanley
(74) *Attorney, Agent, or Firm*—John M Harrison

(57) ABSTRACT

An adjustable C-clamp which includes a generally C-shaped frame fitted with parallel bottom and top clamp seats and threadibly receiving a clamp cylinder at the top clamp seat. A slotted cylinder is secured in the clamp cylinder typically by means of an allen screw, and a clamp rod slidably disposed in the slotted cylinder is fitted with a clamp rod pin. A clamp nut typically attached to one end of the clamp rod faces the bottom clamp seat across the expanse of the clamp frame. The clamp rod pin is designed to traverse a pair of parallel, diametrically-opposed longitudinal cylinder slots in the slotted cylinder to facilitate slidably adjusting the clamp rod in the slotted cylinder and quickly positioning the clamp nut at a selected spacing from the bottom clamp seat. By rotation of the clamp rod in the clamp cylinder, the clamp rod pin is seated in a selected pair of multiple spaced-apart pin slots extending from the respective longitudinal cylinder slots in diametrically-opposed relationship with respect to each other. Continued rotation of the clamp rod facilitates threaded extension of the clamp cylinder through the top clamp seat and advancement of the clamp nut against the bottom clamp seat. In another embodiment, the slotted cylinder is omitted and the longitudinal cylinder slots and respective sets of pin slots are provided in the clamp cylinder.

16 Claims, 4 Drawing Sheets

1
2
3
4
5
5b
5c
6
7
7a
8
9
9a
10
10a
11
12
13
14
15
16
18
19

ADJUSTABLE C-CLAMP

BACKGROUND OF THE INVENTION

Field of the Invention

This invention relates to C-clamps and more particularly, to an adjustable C-clamp which is characterized by a generally C-shaped clamp frame having a top frame segment, an intermediate frame segment and a bottom frame segment, which top and bottom frame segments are fitted with top and bottom clamp seats, respectively. A clamp cylinder is threaded in the top clamp seat substantially parallel to the intermediate frame segment. The clamp cylinder slidably receives a slotted cylinder which is secured in place typically by means of an alien screw, fitted in an allen screw receptacle approximately one-half of which extends through the clamp cylinder and the other half through the slotted cylinder. The slotted cylinder is characterized by a pair of parallel, diametrically-opposed longitudinal cylinder slots each of which communicates with a corresponding set of multiple, vertically spaced-apart, peripheral pin slots. A clamp rod is slidably extended through the bore of the slotted cylinder and is fitted with a pin opening for receiving a clamp rod pin. A clamp nut fitted to the extending end of the clamp rod faces the bottom clamp seat of the clamp frame. Manipulation of a clamp rod grip provided on the opposite end of the clamp rod from the clamp nut facilitates slidably adjustment of the clamp rod inside the slotted cylinder and the clamp cylinder as the clamp rod pin traverses the parallel longitudinal cylinder slots to align with a selected pair of pin slots. Twisting of the clamp rod typically in the clockwise direction as viewed from the clamp rod grip end facilitates movement of respective ends of the clamp rod pin into the pin slots and engagement of the clamp rod pin with the slotted cylinder. Accordingly, the clamp nut can be quickly positioned at a selected spacing from the bottom clamp seat to accommodate a workstock of selected width and thickness between the clamp nut and bottom clamp seat. Continued clockwise rotation of the clamp rod in the slotted cylinder facilitates threaded extension of the clamp cylinder through the top clamp seat of the clamp frame and incremental advancement of the clamp nut against the workstock to secure the workstock between the clamp nut and the bottom clamp seat. In another embodiment, the slotted cylinder is omitted and the longitudinal cylinder slots and respective sets of pin slots are milled, casted or otherwise provided in the bore wall of the clamp cylinder.

One of the problems inherent in conventional C-clamps is the frequent requirement that the threaded rod element be adjusted through the full range of threads in order to accommodate a fairly thick workstock and then adjusted through the same range of movement to accommodate a relatively thin workstock. There is no facility in the conventional C-clamp for quickly effecting an adjustment between a thin workstock and a thick workstock, and vice-versa.

C-clamps are extremely useful tools for various purposes in wood and metal work as they are quite easily used to clamp workstock of varying thicknesses to a workbench, work table or other fixed object and are commonly used for a variety of other purposes. However, the time and effort required to adjust from the thin workstock to the thick workstock and vice-versa, is objectionable and there exists a need in the art for an adjustable C-clamp for quickly and easily effecting this adjustment.

DESCRIPTION OF THE PRIOR ART

One of the adjustable C-clamps known in the art is the "Pressure Unit", detailed in U.S. Pat. No. 2,755,681, dated Jul. 24, 1956, to Merriman. The clamp is characterized by a bushing threaded in the bottom frame member of a C-shaped clamp frame. A clamp rod which is terminated by a pressure foot for engaging a workstock and fitted with multiple teeth is slidably mounted in the bushing. The clamp rod can be slidably extended through the bushing to locate the pressure foot a selected spacing from the top frame member of the clamp frame, and locked in place by inserting a detent in the bushing and between a pair of teeth on the clamp rod. Subsequent rotation of the clamp rod in the bushing threads the bushing through the bottom frame member and gradually advances the pressure foot toward the top frame member. Another adjustable C-clamp is the "Quick Acting C-Clamp" described in U.S. Pat. No. 2,812,789, dated Nov. 12, 1957, to Hutson. The Hutson clamp is characterized by a C-shaped frame having an elongated sleeve which is slidably extendible through one of the parallel frame members of the frame. A threaded shaft terminated by a clamp head for engaging a workstock extends through the sleeve. The sleeve can be adjusted to accommodate a workstock of selected thickness by sliding the sleeve through the frame member and then engaging pawls on the frame with ratchet teeth on the sleeve. The threaded shaft is then rotated to gradually extend the shaft from the sleeve and the clamp head against the workstock. U.S. Pat. No. 3,245,676, dated Apr. 12, 1966, to Floren, et al., discloses a "Quick Acting Plastic Service T Clamp" having a C-shaped frame fitted with an interiorly-threaded sleeve adjustably mounted in one of the parallel frame members at one end of the frame by means of a set screw. A rod fitted with a workstock-engaging member is provided with a threaded collar which engages the interior threads of the sleeve. The workstock engaging member is adjusted with respect to the workstock by sliding the rod and sleeve through the frame member and securing the sleeve at the desired position in the frame member by means of the set screw. The engaging member is then gradually advanced toward the workstock by rotating the rod and threaded collar in the threaded sleeve. A "Screw Clamp" is disclosed in U.S. Pat. No. 3,403,901, dated Oct. 1, 1968, to Servadio. The screw clamp includes a C-shaped frame, a clamping jaw fitted on a first leg and a shaft screw provided on the facing parallel second leg of the frame. A sleeve provided with a slot for accommodating the second leg of the frame is slidably mounted on the shaft screw and a handle screw is threaded on the shaft screw for slidably advancing the sleeve on the shaft screw and toward the workstock. U.S. Pat. No. 3,704,014, dated Nov. 28, 1972, to Keene, describes a "Quick-Adusting C-Clamp" having a C-shaped frame including a pair of arms at respective ends thereof, one of the arms having a stationary clamp jaw. The other arm is provided with a shaft seat and an elongated slot for accommodating a threaded screw terminated by a movable clamp jaw. A nut is threaded on the middle portion of the screw and disengages the shaft seat as a workstock is positioned between the movable and stationary clamp jaws. The shaft is extended through the elongated slot toward the workstock, the nut is seated in the shaft seat and the shaft is rotated in the nut to gradually advance the movable clamp jaw toward the workstock. A "Terminal Clamp" is disclosed in U.S. Pat. No. 4,083,624, dated Apr. 11, 1978, to Timmer. A bearing pad is provided at one end portion of a C-shaped clamp frame, and a tubular member which slidably receives a clamping rod is threadibly mounted in the other end portion of the clamp frame. A one-way rotatable interlock is provided between the clamping rod to induce movement of the tubular member toward the bearing pad. A brake is provided for restraining rotation between the tubular member and the frame. U.S. Pat. No. 4,627,604, dated Dec. 9, 1986, to Choi, describes an "Adjustable Clamp" characterized by a C-shaped frame having a first frame segment fitted with multiple ratchet teeth and a second frame segment provided with a clamp jaw and provided with a handle-operated ratchet for engaging the ratchet teeth and advancing the second frame segment on the first frame segment. A rod provided with a handle and terminated by a movable clamp jaw threadibly engages the first rod segment, and fine adjustment of the movable clamp jaw with respect to the fixed clamp jaw is effected by rotation of the handle. Gross adjustment of the clamp jaws with respect to each other is facilitated by adjusting the second frame segment on the first frame segment using the ratchet handle.

An object of this invention is to provide an adjustable C-clamp which can be quickly and effortlessly adjusted to accommodate workstock of various thicknesses.

Another object of this invention is to provide an adjustable C-clamp which is characterized by a clamp frame fitted with an adjustable clamp cylinder threaded on the clamp frame and a clamp rod mounted in the clamp cylinder, wherein the clamp rod can be slidably adjusted on the frame to accommodate a workstock of selected thickness without the necessity of traversing the entire thread span of the clamp cylinder.

Another object of this invention is to provide an adjustable C-clamp which is characterized by a generally C-shaped clamp frame fitted with a clamp seat at one end and threadably seating a threaded clamp cylinder at the opposite end. A slotted cylinder secured in the clamp cylinder includes a pair of spaced-apart, parallel, longitudinal cylinder slots with multiple, spaced-apart pin slots extending peripherally from the longitudinal cylinder slots, respectively, and a clamp rod extending through the slotted cylinder is fitted with a transverse clamp rod pin for adjustably seating in selected ones of the pin slots to accommodate a workstock of selected thickness between the clamp seat and the extending end of the clamp rod.

Still another object of this invention is to provide an adjustable C-clamp which utilizes a series of transverse pin slots extending from each of a pair of longitudinal, diametrically-opposed, parallel cylinder slots to accommodate a clamp rod pin extending transversely through a clamp rod and facilitate adjustment of the clamp rod on the C-clamp frame to accommodate workstock of varying thickness.

Yet another object of this invention is to provide an adjustable C-clamp which is characterized by a generally C-shaped clamp frame. A threaded clamp cylinder extends through one end of the frame and a slotted cylinder having a pair of longitudinal cylinder slots and multiple, spaced-apart peripheral pin slots extending from each of the cylinder slots is seated in the clamp cylinder for receiving a clamp rod with a transverse clamp rod pin, such that the clamp rod pin may be slidably oriented in the longitudinal cylinder slots to facilitate extending the clamp rod from the cylinder clamp and quick adjustment of the clamp rod to accommodate a workstock of selected width and thickness, and the clamp rod pin selectively seated in a selected pair of the pin slots by rotating the clamp rod in the slotted cylinder to threadibly advance the clamp cylinder on the clamp frame and engage the clamp rod against the workstock.

SUMMARY OF THE INVENTION

These and other objects of the invention are provided in a new and improved adjustable C-clamp having a generally C-shaped clamp frame of selected size, a clamp seat provided in one end of the frame and a clamp cylinder threaded in the opposite end of the frame in spaced-apart relationship with respect to the clamp seat. A slotted cylinder is secured in the clamp cylinder bore of the clamp cylinder typically by means of an alien screw. The slotted cylinder is fitted with a pair of spaced-apart, longitudinal, parallel cylinder slots each communicating with a corresponding set of vertically spaced-apart pin slots. A clamp rod terminated by a clamp nut extends through the slotted cylinder and is fitted with a transverse clamp rod pin, such that the clamp rod may be manipulated inside the slotted cylinder to cause the clamp rod pin to traverse the longitudinal cylinder slots and quickly and effortlessly locate the clamp nut of the clamp rod a selected distance from the clamp seat for accommodating a workstock of selected thickness in the clamp frame. With a typically clockwise rotation of the clamp rod, the clamp rod pin can be inserted in a selected pair of the pin slots and caused to engage the slotted cylinder, wherein continued clockwise rotation of the clamp rod in the slotted cylinder and clamp cylinder causes rotation of the threaded clamp cylinder in the clamp frame and gradual advancement of the clamp nut toward and against the workstock. In another embodiment, the slotted cylinder is omitted and the longitudinal cylinder slots and respective sets of pin slots are milled or otherwise provided in the bore wall of the clamp cylinder.

BRIEF DESCRIPTION OF THE DRAWINGS

The invention will be better understood by reference to the accompanying drawings, wherein.

DESCRIPTION OF THE PREFERRED EMBODIMENTS

Figures 1, 2, 2A, 3, 4, 4A, 5, 5A, 6:
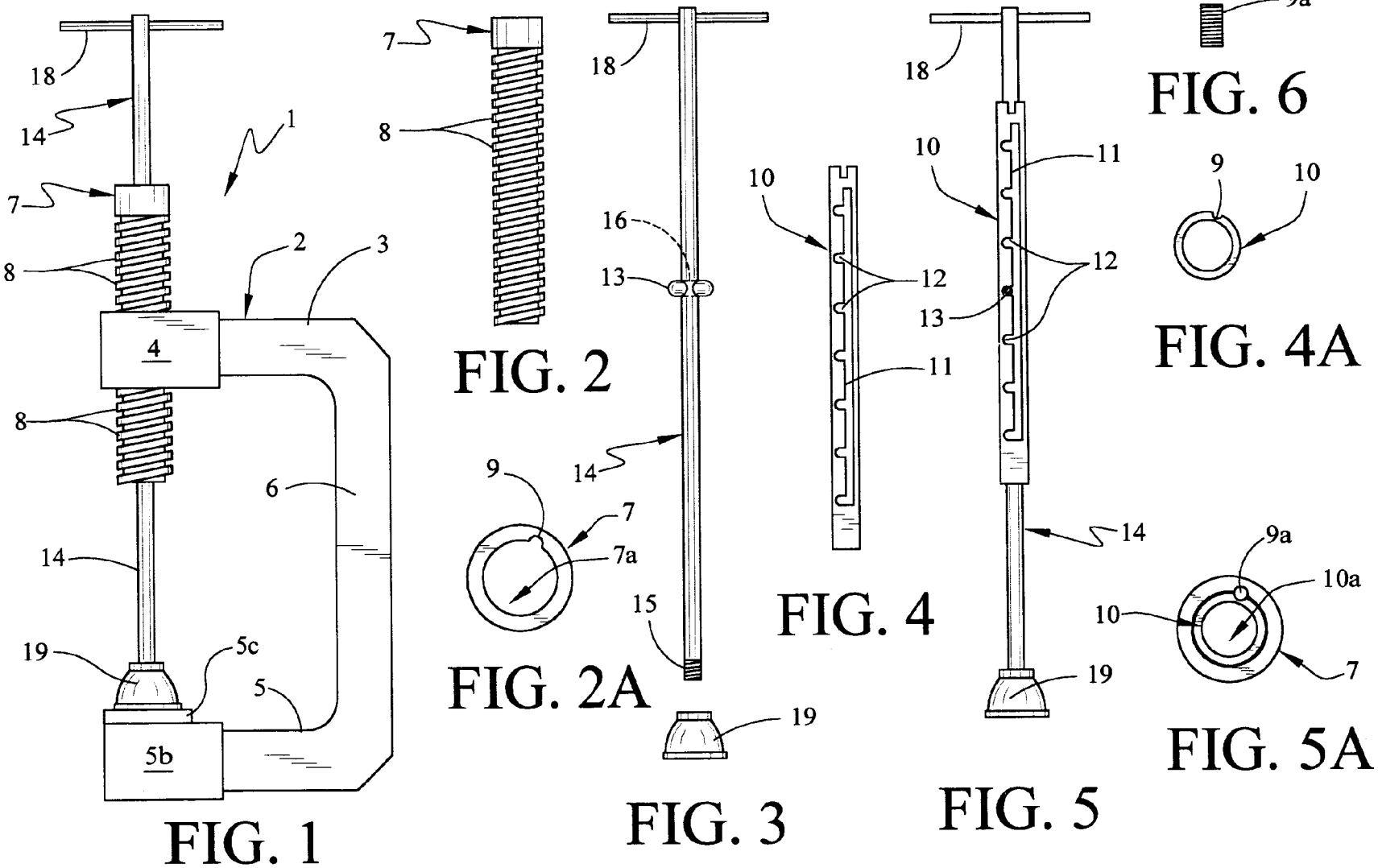
FIG. 1 is a side view of a preferred embodiment of the adjustable C-clamp of this invention.
FIG. 2 is a side view of the clamp cylinder element of the adjustable C-clamp illustrated in FIG. 1.
FIG. 3 is a side view of the clamp rod, clamp nut and clamp rod grip elements of the adjustable C-clamp illustrated in FIG. 1, with the clamp nut unthreaded from the clamp rod.
FIG. 4*a* is a top view of the slotted cylinder element of the adjustable C-clamp illustrated in FIG. 1, particularly highlighting an allen screw receptacle.
FIG. 4 is a side view of the slotted cylinder element of the adjustable C-clamp illustrated in FIG. 1.
FIG. 5 is a side view of the slotted cylinder element illustrated in FIG. 4 with the clamp rod element illustrated in FIG. 3 disposed therein, more particularly illustrating the pin of the clamp rod positioned in a selected pin slot provided in the slotted cylinder.
FIG. 5*a* is a top view of the slotted cylinder-clamp rod combination illustrated in FIG. 5, more particularly illustrating the position of an allen screw therein to prevent the slotted cylinder from rotating inside the clamp cylinder.
FIG. 6 is a side view of a typical allen screw for insertion as illustrated in FIG. 5*a;*

Referring initially to FIGS. 1–6 of the drawings, the adjustable C-clamp of this invention is generally illustrated by reference numeral 1. The adjustable C-clamp 1 is characterized by a generally C-shaped clamp frame 2 of selected size having a top frame segment 3 and a bottom frame segment 5, spanned by an intermediate frame segment 6. A top clamp seat 4 and a bottom clamp seat 5*b* terminate the top frame segment 3 and bottom frame segment 5, respectively, and a seat pad 5*c* is typically mounted on the bottom clamp seat 5*b* in facing relationship to the top clamp seat 4. The clamp cylinder threads 8 of a clamp cylinder 7 which is traversed by a clamp cylinder bore 7 a as illustrated in FIG. 2*a*, are threaded into engagement with corresponding internal threads (not illustrated) of a cylinder opening (also not illustrated), provided in the top frame segment 4. As illustrated in FIGS. 2*a* and 4, respectively, an allen screw receptacle 9 is provided in one end of both the clamp cylinder 7 and a slotted cylinder 10 which is slidably fitted inside the clamp cylinder bore 7*a* of the clamp cylinder 7, as illustrated in FIG. 5*a*. An allen screw 9*a* is threaded into the registering allen screw receptacles 9 of the clamp cylinder 7 and slotted cylinder 10 as further illustrated in FIG. 5*a* to removably secure and prevent rotation of the slotted cylinder 10 inside the clamp cylinder 7, as hereinafter further described.

Figure 15:
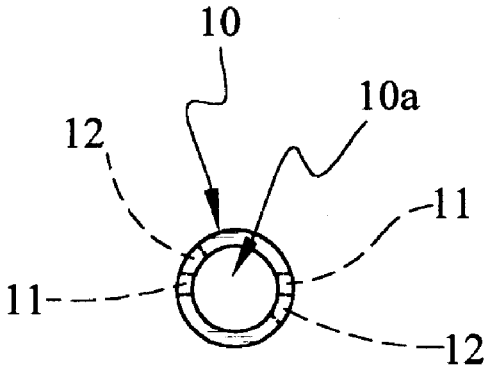
FIG. 15 is a top view of the slotted cylinder element, illustrated in FIG. 4, of the adjustable C-clamp illustrated in FIG. 1.

Referring now to FIGS. 4, 5 and 15 of the drawings, the slotted cylinder 10 includes a slotted cylinder bore 10*a* and a pair of spaced-apart, parallel, longitudinal cylinder slots 11 having a set of spaced-apart transverse pin slots 12 extending peripherally from each of the longitudinal cylinder slots 11 as illustrated in FIG. 4. As illustrated in phantom FIG. 15, the longitudinal cylinder slots 11 are substantially diametrically spaced with respect to each other on opposite sides of the slotted cylinder 10, as are the two sets of spaced-apart pin slots 12 with respect to each other. Each pin slot 12 of each set of pin slots 12 is transversely aligned with a corresponding pin slot 12 in the other pin slot 12 set. The longitudinal cylinder slots 11 and the pin slots 12 are designed to receive respective ends of a clamp rod pin 13 fitted transversely through a clamp rod pin opening 16 (illustrated in phantom in FIG. 3) of a clamp rod 14, at substantially the midpoint of the clamp rod 14 as further illustrated in FIGS. 3 and 5. Clamp rod threads 15 are provided on one end of the clamp rod 14 for receiving a clamp nut 19, having corresponding internal clamp nut threads (not illustrated) as further illustrated in FIG. 3. An elongated, rod-shaped clamp rod grip 18 typically extends through the clamp rod 14 adjacent to the upper end thereof to facilitate rotation of the clamp rod 14 in the slotted cylinder 10, as hereinafter described. Accordingly, when the clamp rod 14 is fitted inside the slotted cylinder bore 10*a* of the slotted cylinder 10 with the clamp rod pin 13 initially engaging the longitudinal slots 11, the clamp rod pin 13 is capable of slidably traversing the longitudinal cylinder slots 11 and can be inserted in the selected pair of transversely-aligned pin slots 12 and caused to engage the slotted cylinder 10 at the pin slots 12, by clockwise rotation of the clamp rod 14 in the slotted cylinder 10 as viewed from the clamp rod grip 18 end. Continued clockwise rotation of the clamp rod 14 in the slotted cylinder 10 causes clockwise rotation of the clamp cylinder 7 (secured to the slotted cylinder 10 by means of the allen screw 9*a*, FIG. 5*a*) in the top clamp seat 4 and gradual downward threaded advancement of the clamp cylinder 7 through the top clamp seat 4, as further hereinafter described.

Figure 7:
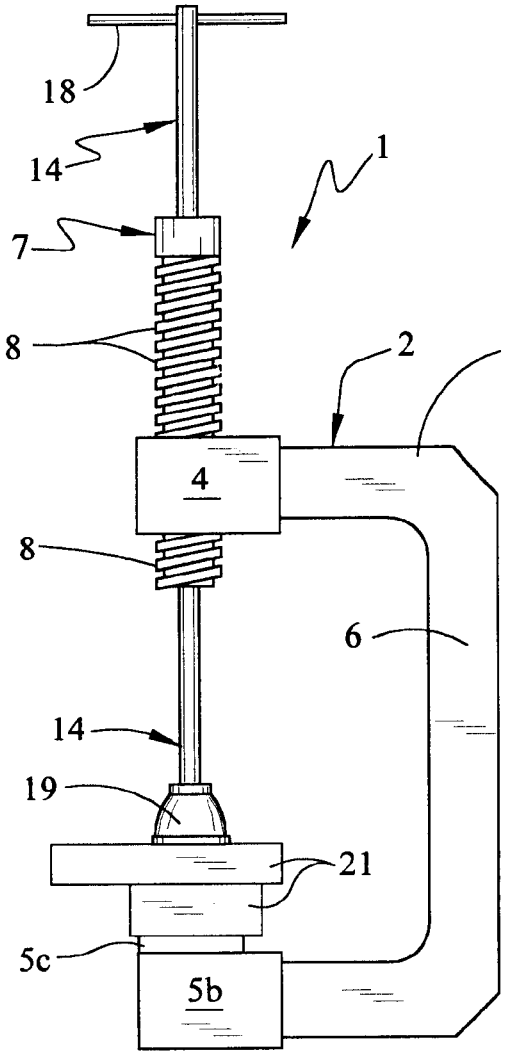
FIG. 7 is a side view of the adjustable C-clamp illustrated in FIG. 1 with a relatively thin workstock inserted between the clamp nut and the seat pad elements thereof.
Figure 8:
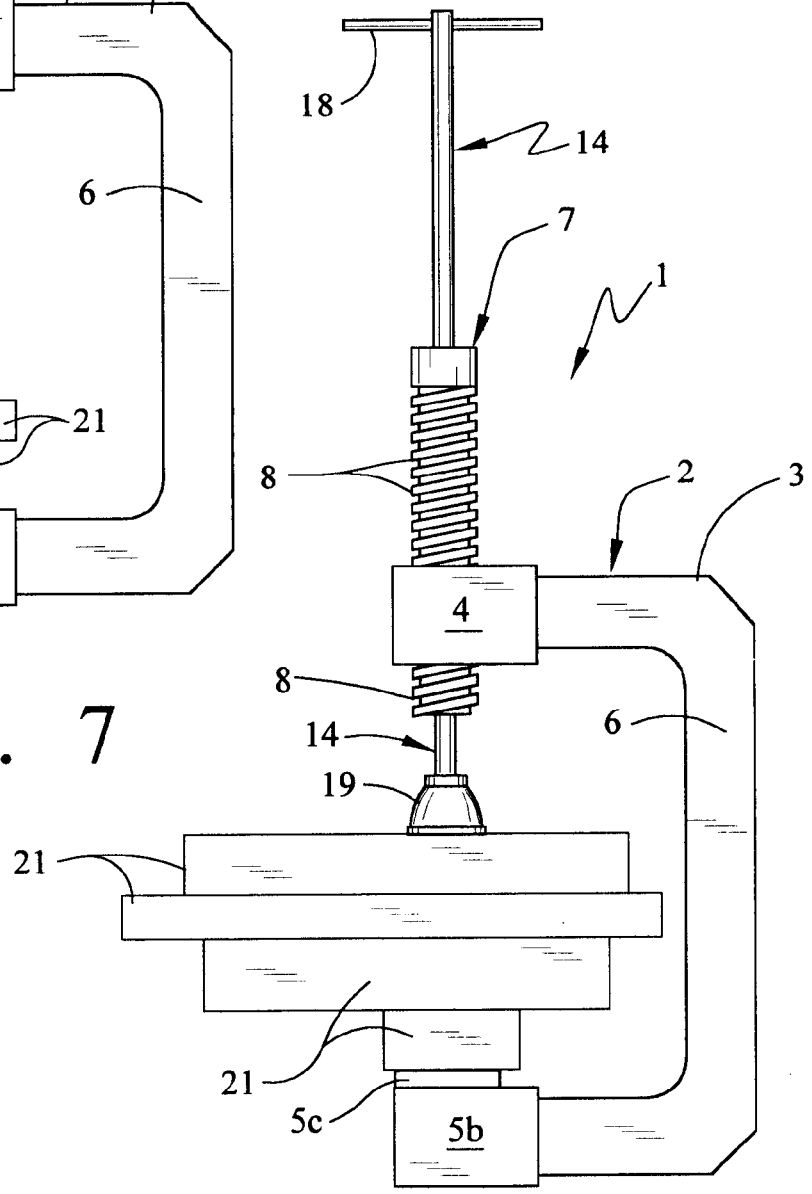
FIG. 8 is a side view of the adjustable C-clamp illustrated in FIG. 1 with a relatively thick workstock inserted between the clamp nut and the seat pad therein.
Figure 9:
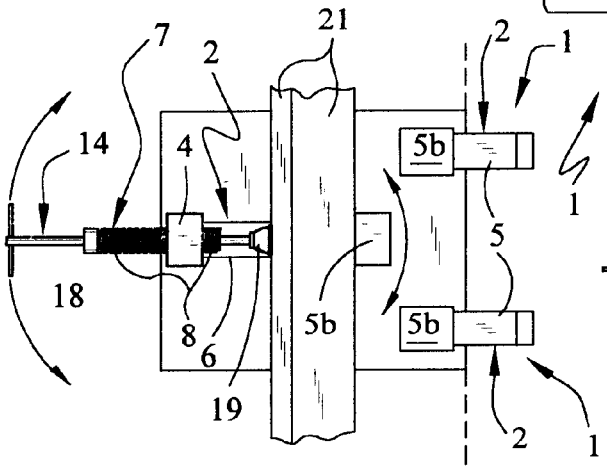
FIG. 9 is a top view of the adjustable C-clamp illustrated in FIG. 1 more particularly illustrating an alternative configuration for clamping a workstock therein.
Figure 11:
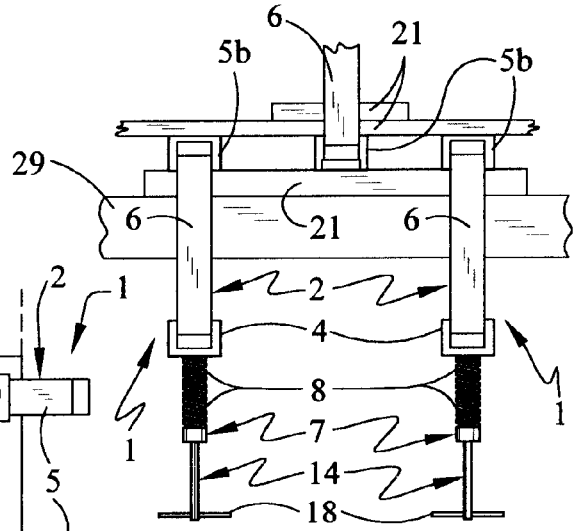
FIG. 11 is a rear view of the adjustable C-clamp illustrated in FIG. 1 more particularly illustrating a use of a pair of adjustable C-clamps for clamping a workstock in place.
Figure 10:
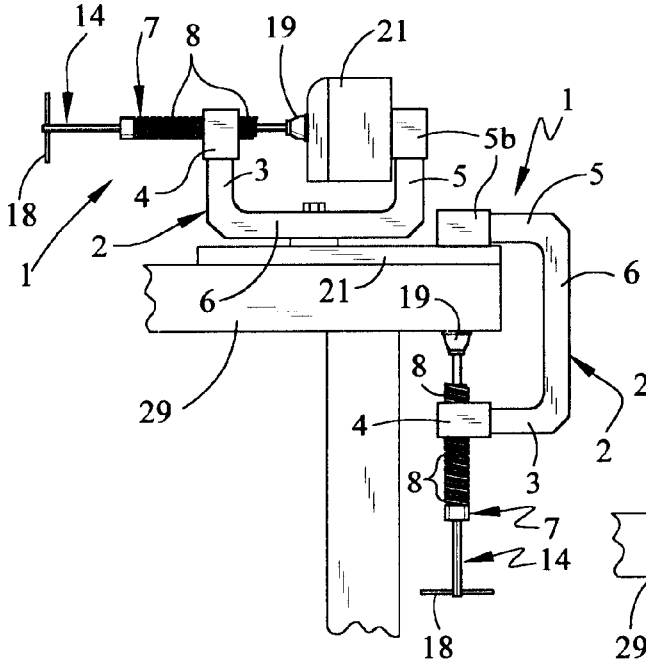
FIG. 10 is a side view of a pair of adjustable C-clamp illustrated in FIG. 1 illustrating a still further configuration for clamping a workstock.
Figure 12:
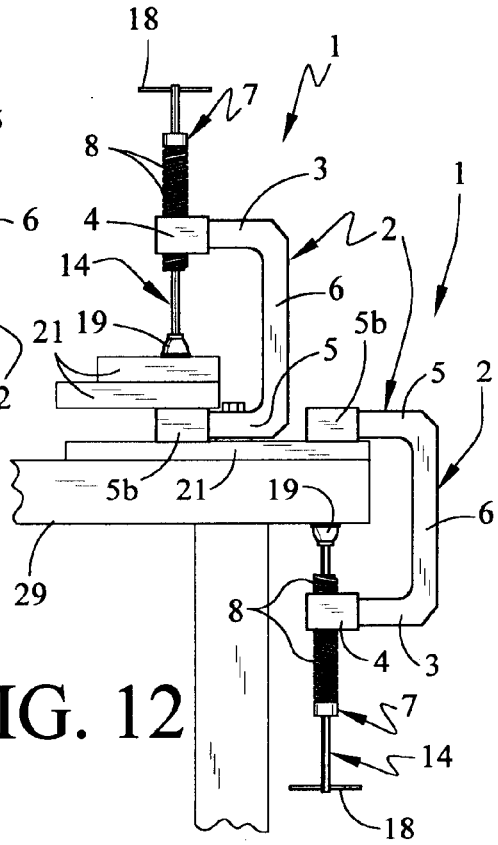
FIG. 12 is a side view of a pair of adjustable C-clamps illustrated in FIG. 1 more particularly illustrating a still further configuration for clamping workstock therein.

In operation, and referring to FIGS. 1, 5 and 7–12 of the drawings, when it is desired to adjust the clamp nut 19 mounted on the end of the clamp rod 14 inside the clamping space between the top clamp seat 4 and the seat pad 5*c* of the bottom clamp seat 5*b*, the clamp rod grip 18 of the clamp rod 14 is initially grasped with one hand. Rotation of the clamp rod 14 in the counterclockwise direction when the adjustable C-clamp 1 is viewed from the clamp rod grip 18 end, insures that the clamp rod pin 13 is free from the pin slots 12 provided in the slotted cylinder 10 and can be slidably traversed in the longitudinal cylinder slots 11. Accordingly, movement of the clamp rod 14 upwardly or downwardly facilitates traversal of the clamp rod pin 13 in the longitudinal cylinder slots 11. Clockwise rotation of the clamp rod 14 causes insertion of the clamp rod pin 13 in a selected pair of the diametrically-opposed pin slots 12 (FIG. 15) and engagement of the clamp rod pin 13 with the slotted cylinder 10 at the selected pair of pin slots 12, to facilitate rotation of the slotted cylinder 10 and clamp cylinder 7 by further manipulation of the clamp rod 14 in the clockwise direction. The clamp cylinder 7 is thus rotated in the clockwise direction in the top clamp seat 4 and gradually advances downwardly through the cylinder opening in the top clamp seat 4, by operation of the clamp cylinder threads 8. This movement causes the clamp nut 19 of the clamp rod 14 to advance toward and engage a workstock 21 placed in the space between the clamp nut 19 and the seat pad 5*c* as illustrated in FIGS. 7 and 8, to secure the workstock 21 in place. Accordingly, it will be appreciated by those skilled in the art that manipulation of the clamp rod 14 effects securing of the clamp rod pin 13 in the appropriate pair of diametrically-opposed pin slots 12 in a selective fashion to accommodate a workstock of selected thickness in the clamp frame 2. The clamp nut 19 is disengaged from the workstock 21 by rotating the clamp rod 14 in the counterclockwise direction in the slotted cylinder 10 to remove the clamp rod pin 13 from the pin slots 12, engage the clamp rod pin 13 against the slotted cylinder 10 at the longitudinal cylinder slots 11 and cause counterclockwise rotation of the clamp cylinder 7 in the top clamp seat 4. As illustrated in FIGS. 9–12, the adjustable C-clamp 1 is capable of a variety of conventional C-clamp uses, such as mounting a workstock 21 on the surface of a table 29; or using the adjustable C-clamp 1 as a vice by securing the clamp frame 2 on the table 29 in horizontal configuration (FIG. 10) or vertical configuration (FIG. 12), and securing the workstock 21 in the adjustable C-clamp 1.

Figure 13:
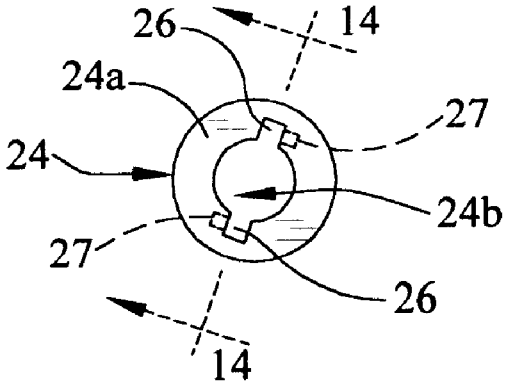
FIG. 13 is a top view of a clamp cylinder element of another embodiment of the adjustable C-clamp.
Figure 14:
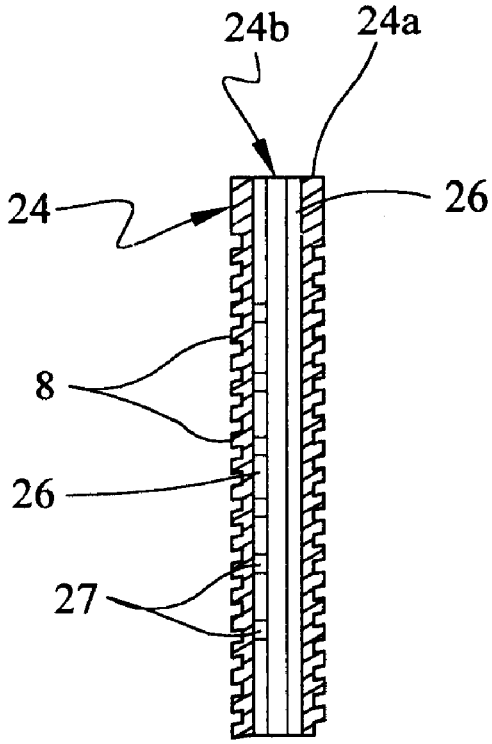
FIG. 14 is a longitudinal sectional view taken along section lines 14—14 in FIG. 13 of the clamp cylinder.

Referring next to FIGS. 13 and 14 of the drawings, in another embodiment the slotted cylinder 10 is omitted from the clamp cylinder 24 and the longitudinal cylinder slots 26 and pin slots 27 are provided in the bore wall 24*a* of the clamp cylinder 24, by means of milling, casting or other suitable techniques known to those skilled in the art. Accordingly, the clamp rod 14 (FIG. 3), slidably disposed in the clamp cylinder bore 24*b*, is capable of extension a selected length from the clamp cylinder bore 24*b* when the clamp rod pin 13 (FIG. 3) is disposed in the longitudinal cylinder slots 26. The clamp rod 14 can be rotated in the clockwise direction to position the clamp rod pin 13 in the selected pair of pin slots 27 and against the bore wall 24*a* and facilitate threaded advancement of the clamp cylinder 24 through the top clamp seat 4 and the clamp nut 19 against the workstock 21, as heretofore described with respect to the embodiment of FIGS. 1–6.

It will be appreciated by those skilled in the art that the adjustable C-clamp of this invention can be quickly and effortlessly adjusted to accommodate workstock of various thickness without having to adjust the clamp cylinder throughout the entire thread range of the clamp cylinder. It is understood that the adjustable C-clamp can be constructed of metal or plastic and in various sizes for a variety of applications and clamping workstock of selected weights and sizes. Referring again to FIGS. 4 and 5 of the drawings, it will be appreciated that any number of pin slots 12 can be provided in the slotted cylinder 10 at any selected spacing with respect to each other depending on the desired quick adjusting capability of the clamp rod 14 in the slotted cylinder 10.

While the preferred embodiments of the invention have been described above, it will be recognized and understood that various modifications may be made in the invention and the appended claims are intended to cover such modifications which may fall within the spirit and scope of the invention.

Having described the invention with the particularity set forth above, what is claimed is:

1. An adjustable C-clamp comprising a clamp frame; a clamp cylinder threadibly engaging said clamp frame; a slotted cylinder engaging said clamp cylinder, a cylinder slot provided in said slotted cylinder and a plurality of pin slots provided in said slotted cylinder in communication with said cylinder slot; a clamp rod carried by said slotted cylinder; and a clamp rod pin carried by said clamp rod for selectively positioning in a selected one of said pin slots and engaging said slotted cylinder responsive to axial rotation of said clamp rod in a first direction and selectively positioning in said cylinder slot and disengaging said slotted cylinder responsive to axial rotation of said clamp rod in a second direction, said clamp rod adjustable with said clamp cylinder on said clamp frame to facilitate gradual adjustment of said clamp rod with respect to said clamp frame when said clamp rod pin engages said slotted cylinder and said clamp rod slidably extendible from said clamp cylinder to facilitate expeditious adjustment of said clamp rod with respect to said clamp frame when said clamp rod pin disengages said slotted cylinder.

2. The adjustable C-clamp of claim 1 wherein said clamp frame comprises a top frame segment, an intermediate frame segment carried by said top frame segment and a bottom frame segment carried by said intermediate frame segment, and wherein said clamp cylinder adjustably engages said top frame segment of said clamp frame.

3. The adjustable C-clamp of claim 1 comprising a clamp nut terminating said clamp rod.

4. The adjustable C-clamp of claim 3 wherein said clamp frame comprises a top frame segment, an intermediate frame segment carried by said top frame segment and a bottom frame segment carried by said intermediate frame segment, and wherein said clamp cylinder adjustably engages said top frame segment of said clamp frame.

5. The adjustable C-clamp of claim 1 wherein said clamp cylinder threadibly engages said clamp frame.

6. The adjustable C-clamp of claim 5 wherein said clamp frame comprises a top frame segment, an intermediate frame segment carried by said top frame segment and a bottom frame segment carried by said intermediate frame segment, and wherein said clamp cylinder threadibly engages said top frame segment of said clamp frame.

7. The adjustable C-clamp of claim 5 comprising a clamp nut terminating said clamp rod.

8. The adjustable C-clamp of claim 7 wherein said clamp frame comprises a top frame segment, an intermediate frame segment carried by said top frame segment and a bottom frame segment carried by said intermediate frame segment, and wherein said clamp cylinder threadibly engages said top frame segment of said clamp frame.

9. An adjustable C-clamp comprising a clamp frame; a clamp cylinder threadibly engaging said clamp frame; an elongated slotted cylinder disposed in said clamp cylinder, said slotted cylinder having a pair of longitudinal cylinder slots disposed in substantially parallel, spaced-apart relationship to each other, and a plurality of pin slots communicating with said pair of longitudinal cylinder slots, respectively; a clamp rod slidably mounted in said slotted cylinder; and a clamp rod pin extending from said clamp rod for selective location in said pair of longitudinal cylinder slots responsive to axial rotation of said clamp rod in a first direction in said slotted cylinder and selective location in a selected one of said plurality of pin slots and engagement with said slotted cylinder responsive to axial rotation of said clamp rod in a second direction in said slotted cylinder, wherein said clamp rod is slidably adjustable in said slotted cylinder to facilitate expeditious adjustment of said clamp rod with respect to said clamp frame when said clamp rod pin is located in said pair of longitudinal cylinder slots, and said clamp rod is adjustable on said clamp frame with said clamp cylinder to facilitate gradual adjustment of said clamp rod with respect to said clamp frame when said clamp rod pin is located in said selected one of said plurality of pin slots.

10. The adjustable C-clamp of claim 9 wherein said clamp frame comprises a top frame segment, an intermediate frame segment carried by said top frame segment and a bottom frame segment carried by said intermediate frame segment, and wherein said clamp cylinder adjustably engages said top frame segment of said clamp frame.

11. The adjustable C-clamp of claim 9 comprising a clamp nut terminating said clamp rod.

12. The adjustable C-clamp of claim 11 wherein said clamp frame comprises a top frame segment, an intermediate frame segment carried by said top frame segment and a bottom frame segment carried by said intermediate frame segment, and wherein said clamp cylinder adjustably engages said top frame segment of said clamp frame.

13. An adjustable C-clamp comprising a clamp frame; a clamp cylinder threadibly engaging said clamp frame, said clamp cylinder having at least one longitudinal cylinder slot and a plurality of pin slots communicating with said at least one longitudinal cylinder slot, respectively; and a clamp rod slidably mounted in said clamp cylinder and a clamp rod pin extending from said clamp rod, said clamp rod pin selectively positioned in said at least one longitudinal cylinder slot responsive to axial rotation of said clamp rod in a first direction in said clamp cylinder, wherein said clamp rod is slidably extendible from said clamp cylinder to facilitate expeditious adjustment of said clamp rod with respect to said clamp frame; and said clamp rod pin selectively positioned in a selected one of said plurality of pin slots responsive to axial rotation of said clamp rod in a second direction in said clamp cylinder, wherein said clamp rod pin engages said clamp cylinder and said clamp rod is adjustable on said frame with said clamp cylinder to facilitate gradual adjustment of said clamp rod with respect to said clamp frame.

14. The adjustable C-clamp of claim 13 wherein said at least one longitudinal cylinder slot comprises a pair of longitudinal cylinder slots provided in said clamp cylinder in substantially parallel, spaced-apart relationship to each other.

15. The adjustable C-clamp of claim 13 wherein said clamp cylinder threadibly engages said clamp frame.

16. The adjustable C-clamp of claim 15 wherein said at least one longitudinal cylinder slot comprises a pair of longitudinal cylinder slots provided in said clamp cylinder in substantially parallel, spaced-apart relationship to each other.

* * * * *